United States Patent [19]

Greene

[11] Patent Number: 4,824,156

[45] Date of Patent: Apr. 25, 1989

[54] HANGER HOLDER

[76] Inventor: Barry N. Greene, P.O. Box 10541, Beverly Hills, Calif. 90213

[21] Appl. No.: 148,077

[22] Filed: Jan. 25, 1988

[51] Int. Cl.[4] ..... A45C 13/26; A45B 3/06

[52] U.S. Cl. ..... 294/142; 294/137

[58] Field of Search ..... 294/142, 137, 141, 143, 294/147, 148, 149, 150, 152, 153, 154, 156, 157, 164, 165, 166, 167, 170

[56] References Cited

U.S. PATENT DOCUMENTS

| | | | |
|---|---|---|---|
| 1,498,247 | 6/1924 | Stewart . | |
| 2,782,974 | 2/1957 | Borgfeldt . | |
| 3,313,460 | 4/1967 | Hooker . | |
| 3,317,955 | 5/1967 | Roscicki . | |
| 3,633,802 | 1/1972 | Webster . | |
| 3,731,809 | 5/1973 | Saenger . | |
| 3,804,310 | 4/1974 | Wheller | 294/142 |
| 3,848,787 | 11/1974 | Hill . | |
| 4,288,012 | 9/1981 | Doak . | |
| 4,730,863 | 3/1988 | Gwadnola | 294/142 |

FOREIGN PATENT DOCUMENTS

| | | | |
|---|---|---|---|
| 2501996 | 9/1975 | Fed. Rep. of Germany | 294/147 |

*Primary Examiner*—James B. Marbert

*Attorney, Agent, or Firm*—Poms, Smith, Lande & Rose

[57] ABSTRACT

An apparatus is disclosed which is used to hold a hanger or hangers. The apparatus claimed provides a loop for attaching one or more hangers and is constructed in such a way to cause the hangers to align in a position comfortable for carrying. A handle is attached to the loop allowing a relatively large number of hangers to be comfortably carried.

35 Claims, 2 Drawing Sheets

Fig. 1.
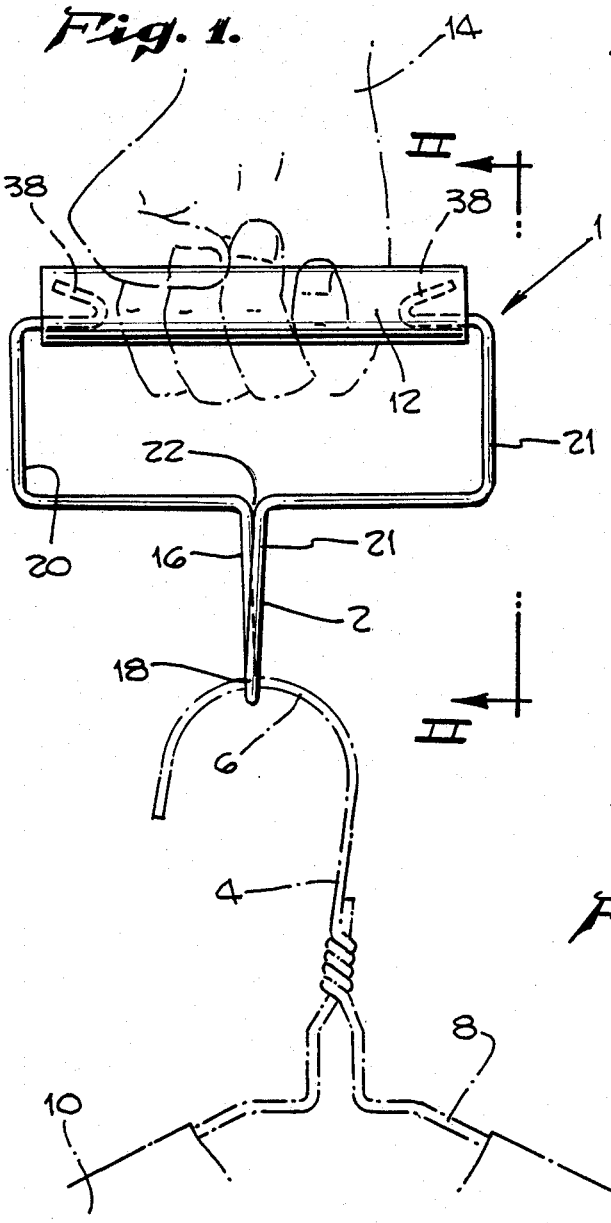
Fig. 2.
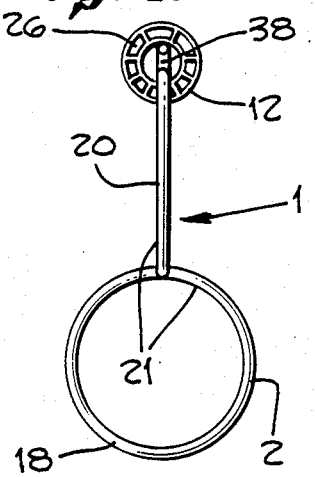
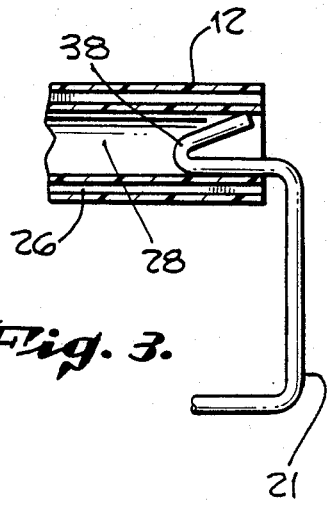
Fig. 3.
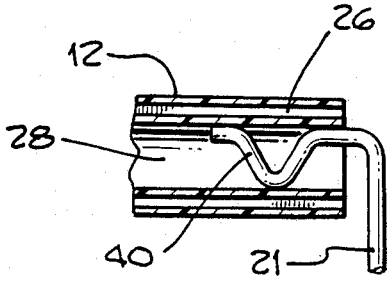
Fig. 4.

HANGER HOLDER

FIELD OF THE INVENTION

This invention relates in general to an apparatus for holding hangers, especially hangers used for supporting clothing.

BACKGROUND OF THE INVENTION

Clothing on hangers often needs to be carried from one point to another, and sometimes for relatively long distances. For example, dry cleaning must be carried from the cleaning shop to the customer's automobile, or sometimes the cleaning shop provides a delivery service which must carry garments on hangers to the customer's location. Holding a number of hangers, especially if the clothing which they support is heavy or bulky, can be quite uncomfortable especially if the person holding the hangers has a small hand. The grasping portions of the hangers tend to crease the hand and fingers creating discomfort and forcing the carrier to switch back and forth between left and right hand in order to minimize the discomfort.

A number of approaches have previously been taken in order to devise means for carrying hangers comfortably. However, none of the previous attempts has succeeded in developing a hanger holder which is easy to use and inexpensive to manufacture. Prior designs have been complicated, difficult to manufacture and not suited to their intended purposes. For example, the patents issued to Stewart, U.S. Pat. Nos. 1,498,247, Borgfeldt, 2,782,974, Hooker, 3,313,460, Roscicki, 3,317,055, Webster, 3,633,802, Saenger, 3,731,809, Hill, 3,848,787 and Doak, 4,288,012 all disclose apparatus for carrying packages and hangers but are very complicated and difficult to manufacture. Some of them are bulky and difficult to store or are complicated to use.

Accordingly, the principal objects of the present invention are to provide hanger holder which is both easy to use and to manufacture. Rather than to provide a complex construction to achieve the purpose of comfortably transporting hangers, the inventor has developed a simple and straightforward apparatus which meets the requirements of the commercial marketplace.

SUMMARY OF THE INVENTION

In a broad aspect of the invention, a hanger holder for holding hangers which have body portions and grasping portions is provided with a loop on which one or more hangers may be attached, a handle for carrying the loop and hangers attached thereto, and a means for connecting the loop to the handle. The loop includes portions which lie in a direction essentially parallel to the fingers of a hand holding the handle.

In accordance with another aspect of the invention, the loop portions are held in their essentially parallel direction with respect to the fingers of the hand, essentially rigidly with respect to the handle means during normal use of the hanger holder.

Additionally, the loop portions include biasing means for biasing the hanger or hangers being held into a direction where the hanger body or bodies are held essentially perpendicular to the handle and to the fingers of a hand holding the handle.

In another aspect of the invention, the connecting means and the loop are formed from a single piece of wire. This aspect could take the form of having the loop created by making a twist in the wire. Additionally, a locking means may be provided to prevent separation of the twisted portion in the wire.

In accordance with another aspect of the invention, the handle means includes a cellular internal structure. The handle may include a hollow internal portion or be constructed of solid material.

The handle may be provided with a cutout for hanging the handle over a hook similar to the clothing hook inside a passenger automobile.

Means for securing the connecting means to the handle are provided in the invention. The means for securing includes one or more lengthened portions on the wire which are located within the handle.

In another aspect of the invention, the lengthened portions of the wires are provided with hooks at their ends which are joined together within the handle means.

In yet another aspect of the invention, the lengthened portions on the wire include one or more bends placed within the handle means for increasing the holding strength within the handle.

In a further aspect of the invention, the wire portion of the hanger holder is resilient to provide flexion which acts as a shock absorber both horizontally and vertically.

Other objects, features and advantages of the invention will become apparent from a consideration of the following detailed description and the accompanying drawings.

BRIEF DESCRIPTION OF THE DRAWINGS

FIG. 1 is a front view of a hanger holder showing a clothing hanger in phantom lines and a hand beginning its grasping motion around the handle means.

FIG. 2 is a side view of the hanger holder depicted in FIG. 1.

FIG. 3 is cutaway view of one end of the handle depicting a means for securing having a bend in the wire.

FIG. 4 is an alternative construction of the bend shown in FIG. 3.

DETAILED DESCRIPTION

Figure 5:
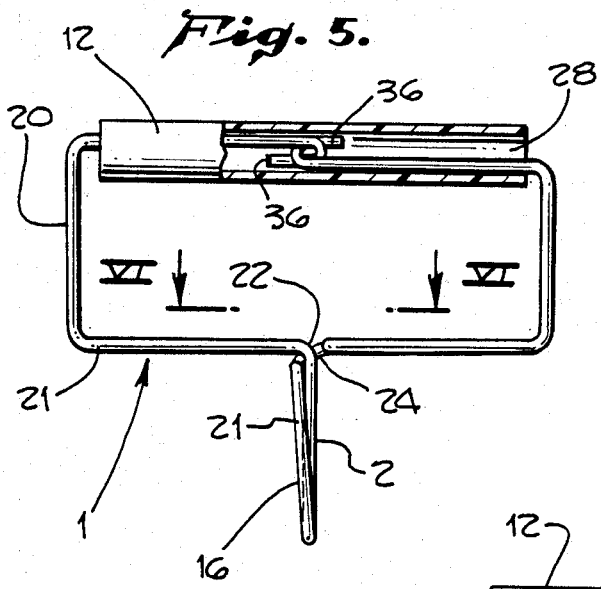
FIG. 5 is a front view of the hanger holder showing a partial cutaway of the handle and hooks in the wires which are joined together within the handle means. A twist in the loop showing a locking means is also depicted.

A preferred embodiment of a hanger holder 1 is depicted in FIG. 1. Loop means are depicted as loop 2 for attaching one or more hangers 4. FIG. 1 depicts a hanger 4 in phantom lines, showing its grasping portion 6 attached to loop 2. The body portion 8 is shown supporting a garment 10. Handle means are shown as handle 12 for carrying the loop means. A hand 14 is shown as it is beginning to grasp handle 12. Loop portions 16 lie in a direction which is essentially parallel to the fingers of a hand which is holding the handle 12 when the hanger holder 1 is in normal use.

An advantage to using a loop 2 as the loop means is that the hangers 4 center themselves in the loop 2 keeping the center of gravity stabilized.

As can be readily envisioned, when the loop portions 16 are placed in such an arrangement; namely, being essentially perpendicular to the fingers of the hand 14, then the hanger 4 will have a tendency to lie in a direction perpendicular to the loop portions 16 and the fingers of the hand 14. The hangers 4 and garments 10 will thereby align themselves comfortably with respect to the body of the user of the hanger holder 1 whether the garments 10 are held over the shoulder, or at the side of the user.

In one aspect of the invention, the loop portions 16 are held in their essentially parallel direction to the fingers of a user's hand 14 essentially rigidly with respect to the handle means 12 during normal use of the hanger holder 1. This facilitates alignment of the hangers 4 and garments 10 in a direction perpendicular to the fingers of the user's hand 14 making carrying of the hanger holder 1 and garments 10 more comfortable.

Biasing means 18 for biasing the hanger 4 into a direction where the hanger 4 is held essentially perpendicular to the fingers of a hand 14 holding the handle 12 are, in the preferred embodiment, the interior portions of loop portions 16. A more complicated construction may be chosen, however, it has been found that the curve of the loop 2 and loop portions 16 will gently ease a hanger or hangers 4 into a position essentially perpendicular to the fingers of a hand 14 so that no more complicated mechanism is required. The biasing means 18 works especially efficiently if more than two hangers are attached to loop 2.

Means for connecting the loop 2 to the handle 12 is shown in structure 20. In the preferred embodiment, the structure 20 and the loop 2 are formed from a single piece of wire.

As depicted in FIG. 1, and generally throughout the drawings, the structure 20 is a round wire 21 of essentially the same type of material from which hangers 4 are constructed. However, the wire 21 may be of any cross-sectional shape, e.g. round, square, hexagonal or any other polygonal shape, a ribbon, strip, slender rod or otherwise. The wire 21 may be extruded, machined, forged or fashioned in any other way chosen. The wire 21 may be made from any suitable material such as steel or aluminum. Plastic wire or wire made from exotic materials may also be used if desired.

The structure 20 and loop 2 may be made from wire which is either stiff or resilient. Resilient wire is preferred because it acts as a shock absorber both in the vertical and horizontal directions, which is especially important if a number of heavy garments 10 are being held with the hanger holder 1. As the user walks, the "give" in the resilient wire will reduce the stress felt by the fingers and hand 14 of the user.

Figure 6:
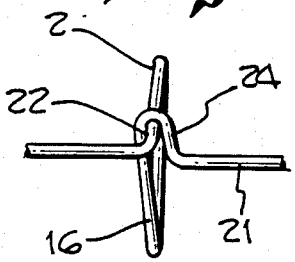
FIG. 6 is a top view of the locking means taken along the plane VI—VI of FIG. 5.

In the preferred embodiment, the loop 2 is formed by making bends 22 in wire 21. The bends 22 may be a simple bends as depicted in FIG. 1 or they may be formed by a single twist or they may be twisted more than once or in a more complicated manner. However, simple bends 22 have been found to be quite effective. A locking means 24 may be added to the bends 22 to prevent separation of the loop 2 from the structure 20 and a separation of the bends 22 and a collapse of the structure 20. If the wire 21 is properly chosen and has sufficient mechanical properties, then a locking means 24 will not be required. However, if a wire 21 is chosen for economic or other considerations which does not have sufficient strength and form retention characteristics, then a locking means 24 as depicted in FIGS. 5 and 6 may be required, or an equivalent construction thereto.

The handle 12 may be made in various ways, and the drawings depict several. A cellular internal construction 26 is depicted in FIG. 2. The advantage of such a construction is that the handle 12 can be made quite strong but yet remain very lightweight. In a preferred embodiment, handle 12 has a cellular internal construction 26, and is made from a plastic material which is easily formed or extruded. An advantage to this type of construction is that the handle 12 can be made slightly flexible if desired, to increase the comfort factor when the hanger holder 1 is being held in the hand 14.

Figure 7:
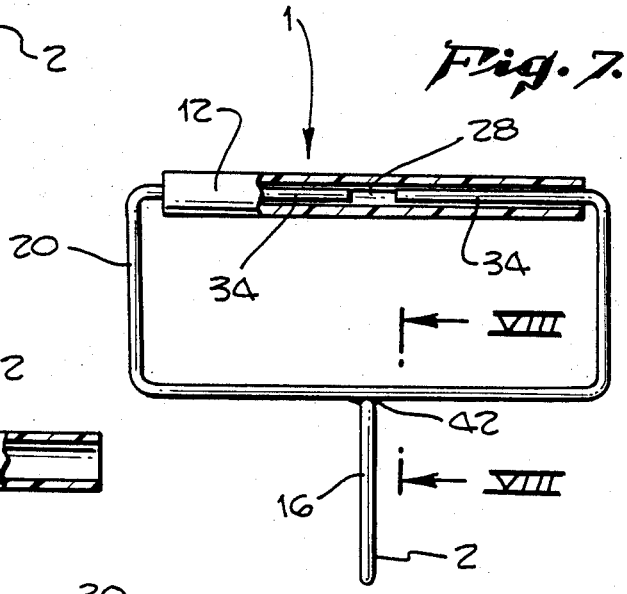
FIG. 7 is a front view of the hanger holder with a partial cutaway of the handle to show lengthened portions of the wire located within the handle means.

The handle 12 may also be hollow. A hollow internal portion 28 is depicted in FIGS. 5 and 7. The handle 12 may be made from any suitable material such as plastic, heavyweight paper, metal, wood, composites or their equivalents.

Figure 9:
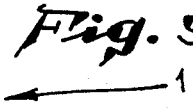
FIG. 9 is a front view of another embodiment of the hanger holder depicting a solid handle and a loop connected non-rigidly to the wire.

A solid handle 30 is depicted in FIG. 9. The solid handle 30 may be made of any suitable material including plastic. The solid handle 30 may be molded around wire ends 32 for a very secure fit. That is, wire ends 32 may be placed in a mold with the plastic or other material of the solid handle 30 being added to the mold and flowing or being forced around the wire ends 32.

The drawings depict several means for securing the means for connecting or structure 20 to the handle 12. The means for securing may include lengthened portions 34 on the wire as shown in FIG. 7 which lie within handle 12. The length of the lengthened portions 34 are chosen so that they may be easily inserted into the handle 12 but yet stay within the handle 12 when the hanger holder 1 is in use with hangers 4 attached to loop 2. Lengthened portions 34 may be used in any type of handle 12 construction, including cellular internal construction 26, hollow construction 28 or solid handle 30.

Hooks 36 may be added to the lengthened portions 34 which are joined together within the handle 12 to firmly hold the lengthened portions 34 of the wire within the handle 12.

Alternatively, the lengthened portions 34 may include one or more bends which are located within the handle 12 for increasing the holding strength of the means for securing. A simple bend 38 may be used as depicted in FIGS. 1 and 3, a double bend 40 as depicted in FIG. 4 may be used or any other equivalent construction. It can be seen that when a load is attached to loop 2, bends 38 and 40 will rotate slightly and wedge themselves firmly into the interior walls of hollow portion 38 within handle 12.

Figure 8:
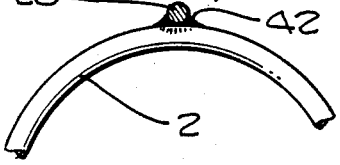
FIG. 8 is a side view of the loop at the point it is connected to the wire along plane VIII—VIII of FIG. 7, and shows a welded attachment of the loop to the wire.

An alternative to a bends 22 is depicted in FIGS. 7 and 8. Rather than having structure 20 and loop 2 made from a single piece of wire 21, structure 20 and loop 2 are made separately and joined together at weld 42.

Another alternative embodiment is depicted in FIG. 9. Structure 20 and loop 2 are made separately and attached together by connector 44. The structure 20 is formed with a dip or notch 46 which acts to bias loop 2 into a position so that loop portions 16 lie in a direction essentially parallel to the fingers of a hand 14 holding handle 12 in normal use.

Figure 10:
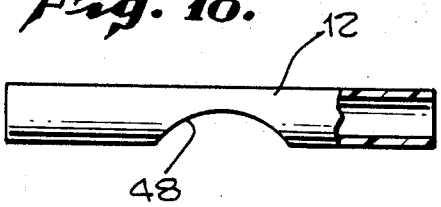
FIG. 10 is a top view of a handle showing a cutout for placing over a hook, as in an automobile.
Figure 10:
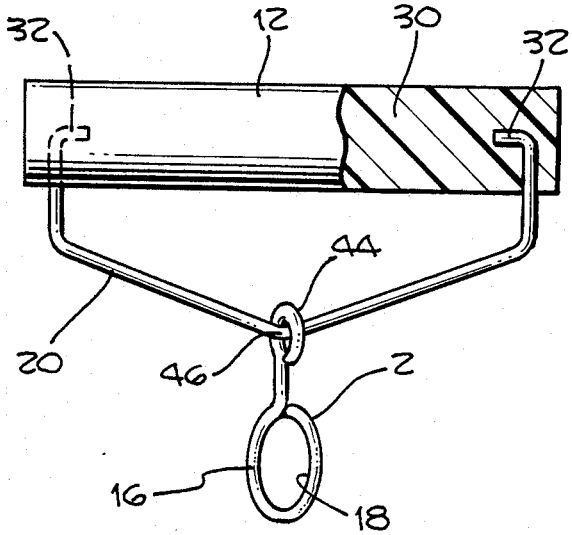

A cutout or thin portion 48 on handle 12 may be added as a means for attaching the hanger holder to a hook so that the entire hanger holder 1 and the hangers 4 and garments 10 attached thereto may be placed over the clothing hook found in most automobiles. This is depicted in FIG. 10. A user could then, for example, pick up dry cleaning from a shop, attach the hangers 4 to the loop 2, carry the hanger holder 1 to the car, and then place the hanger holder 1 on the clothing hook in the car by placing the thin portion 48 over the car hook. The garments will lie essentially parallel to the window or door of the car directly under the car hook, the preferred position. The means for attaching may also be a hook or loop type appendage to the handle 12.

It is to be understood that the disclosed apparatus is merely illustrative of the principles of the present invention which could be implemented by other types of structures constructed of different materials. Accordingly, the scope of the present invention is not limited to the embodiments as shown in the drawings and specifically described herein.

What is claimed is:

1. A hanger holder for holding hangers which have body portions and grasping portions comprising:

loop means for attaching one or more hangers;

handle means for carrying the loop means;

means for connecting the loop means to the handle means; and said loop means having loop portions which lie in a direction essentially parallel to the fingers of a hand holding the handle means.

2. The hanger holder of claim 1 wherein said loop portions are held in said essentially parallel direction essentially rigidly with respect to the handle means during normal use of the hanger holder.

3. The hanger holder of claim 1 wherein said loop portions include biasing means for biasing the hanger or hangers being held into a direction where the hanger body or bodies are held essentially perpendicular to the fingers of a hand holding the handle means.

4. The hanger holder of claim 1 wherein the means for connecting and the loop means are formed from a single piece of wire.

5. The hanger holder of claim 4 wherein the loop means is formed by making one or more bends in said wire.

6. The hanger holder of claim 5 further comprising a locking means for preventing separation of the twisted portion in the wire.

7. The hanger holder of claim 1 wherein the handle means includes a cellular internal structure.

8. The hanger holder of claim 1 wherein the handle means includes a hollow internal portion.

9. The hanger holder of claim 1 wherein the handle means is a solid material.

10. The hanger holder of claim 4 further comprising means for securing the means for connecting to the handle means.

11. The hanger holder of claim 10 wherein the means for securing includes one or more lengthened portions on said wire which are located within the handle means.

12. The hanger holder of claim 10 wherein the means for securing includes lengthened portions on said wire, and hooks at the ends of the lengthened portions which are joined together within the handle means.

13. The hanger holder of claim 10 wherein the means for securing includes one or more lengthened portions on said wire, and one or more bends in the lengthened portions located within the handle means, for increasing the holding strength of the means for securing.

14. The hanger holder of claim 4 wherein the wire is resilient.

15. The hanger holder of claim further comprising a means for attaching the hanger holder to a hook.

16. A hanger holder hangers which have body portions and grasping portions comprising:

loop means for attaching one or more hangers;

handle means for carrying the loop means;

means for connecting the loop means to the handle means;

said loop means having loop portions which lie in a direction essentially parallel to the fingers of a hand holding the handle means; and said loop portions being held in said essentially parallel direction essentially rigidly with respect to the handle means during normal use of the hanger holder.

17. The hanger holder of claim 16 wherein said loop portions include biasing means for biasing the hanger or hangers being held into a direction where the hanger body or bodies are held essentially perpendicular to the fingers of a hand holding the handle means.

18. The hanger holder of claims 16 wherein the means for connecting and the loop means are formed from a single piece of wire.

19. The hanger holder of claim 18 wherein the loop means is formed by making one or more bends in said wire.

20. The hanger holder of claim 19 further comprising a locking means for preventing separation of the twisted portion in the wire.

21. The hanger holder of claim 16 wherein the handle means includes a cellular internal structure.

22. The hanger holder of claim 16 wherein the handle means includes a hollow internal portion.

23. The hanger holder of claim 16 wherein the handle means is a solid material.

24. The hanger holder of claim 18 further comprising means for securing the means for connecting to the handle means.

25. The hanger holder of claim 24 wherein the means for securing includes one or more lengthened portions on said wire which are located within the handle means.

26. The hanger holder of claim 24 wherein the means for securing includes lengthened portions on said wire, and hooks at the ends of the lengthened portions which are joined together within the handle means.

27. The hanger holder of claim 24 wherein the means for securing includes one or more lengthened portions on said wire, and one or more bends in the lengthened portions located within the handle means, for increasing the holding strength of the means for securing.

28. The hanger holder of claim 18 wherein the wire is resilient.

29. The hanger holder of claim 16 further comprising a means for attaching the hanger holder to a hook.

30. The hanger holder of claim 16 wherein the handle means includes a hollow internal portion along the longitudinal axis of the handle.

31. The hanger holder of claim 24 wherein the means for securing includes one or more lengthened portions on said wire which are located within the handle means, said lengthened portions not being affixed to one another.

32. The hanger holder of claim 24 wherein the means for securing includes one or more lengthened portions on said wire and ends on said lengthened portions which are located within the handle means.

33. The hanger holder of claim 29 wherein the means for attaching includes a thin portion in the handle means for placing the hanger holder over a hook.

34. The hanger holder of claim 29 wherein the means for attaching includes a hook in the handle means for placing the hanger holder over a hook.

35. The hanger holder of claim 29 wherein the means for attaching includes a loop in the handle means for placing the hanger holder over a hook.

* * * * *

UNITED STATES PATENT AND TRADEMARK OFFICE

CERTIFICATE OF CORRECTION

PATENT NO. : 4,824,156

DATED : April 25, 1989

INVENTOR(S) : Barry N. Greene

It is certified that error appears in the above-identified patent and that said Letters Patent is hereby corrected as shown below:

Column 6, line 8, (Claim 15), after "The hanger holder of claim" insert -- 1 --.

Signed and Sealed this

Fifth Day of December, 1989

*Attest:*

JEFFREY M. SAMUELS

*Attesting Officer*

*Acting Commissioner of Patents and Trademarks*